United States Patent [19]

Garbe

[11] Patent Number: 4,632,274

[45] Date of Patent: Dec. 30, 1986

[54] BEVERAGE DISPENSER

[76] Inventor: Manfred Garbe, 9 Downing Street, Downsview, Ontario, Canada

[21] Appl. No.: 622,488

[22] Filed: Jun. 20, 1984

[30] Foreign Application Priority Data

Aug. 3, 1983 [CA] Canada ..... 433802

[51] Int. Cl.[4] ..... G07F 13/10

[52] U.S. Cl. ..... 221/96; 221/132

[58] Field of Search ..... 221/12, 96, 123, 126, 221/127, 132, 133, 191, 195, 221, 222, 223

[56] References Cited

U.S. PATENT DOCUMENTS 4,195,751 4/1980 Smith ..... 221/96 X

FOREIGN PATENT DOCUMENTS 2042482 9/1980 United Kingdom ..... 221/96

2090821 7/1982 United Kingdom ..... 221/133

*Primary Examiner*—F. J. Bartuska

[57] ABSTRACT

A novel cup dispenser, dispensing apparatus, beverage dispenser and components therefor, and a novel process for dispensing comestibles incorporating water (for example, a beverage or soup).

32 Claims, 10 Drawing Figures

BEVERAGE DISPENSER

FIELD OF INVENTION

This invention relates to a novel cup dispenser, dispensing apparatus, beverage dispenser and components therefor, and a novel process for dispensing comestibles incorporating water (for example, a beverage or soup).

BACKGROUND OF THE INVENTION

Many approaches have been taken in the construction of beverage dispensing machines from which a number of different beverages may be dispensed. In some, an individual cup from a magazine in the dispensing machine is deposited at a delivery station in the machine and water and dry ingredients are added to the cup at the station. The filled cup is then retrieved by the purchaser. The difficulties with this approach include:

(a) the size of dispenser required to house the components (including discharge chutes) necessary for the dispenser's operation, (b) the manner and the length of time of the storage of the ingredients to ensure their freshness, and (c) the adherence of ingredients to the machinery component parts.

A newer approach to the construction of the dispensers comprises the discharge of a cup from a stack or magazine of cups, each cup already carrying a premeasured amount of ingredients for the beverages and the delivery of the discharged cup down a chute to the delivery position. The difficulty with this approach is once again, the size and complexity of the machine.

In an attempt to limit the size of the dispensing machine and at the same time maximize the number of stacks or magazines capable of being carried by the beverage dispensing machine, mechanisms have been provided that rotate the entire shelf ("carousel") in which the cup stacks or magazines in the machine are mounted to position a stack of cups over a discharge station. A discharge mechanism mounted at the station then causes the lowermost cup to drop. Water is then added at either the station or a delivery station to which the cup is subsequently brought. The difficulties with this approach comprise the size and cost of the motor and other components required to rotate the "carousel" and spillage of beverage during the movement of the water filled cups from the filling station to the discharge station. In regards to these and other approaches, see U.S. Pat. Nos. 1,634,036; 1,882,812; 1,885,367; 2,019,016; 2,571,383; 3,576,267 and 3,951,303 (which corresponds to U.K. Pat. No. 1,449,818).

None of those systems however, provide a cup dispenser or apparatus, vending machine or a beverage dispenser or apparatus which maximizes its storage and dispensing ability, while minimizing size, spillage and storage problems.

It is therefore an object of this invention to provide improved cup dispensers or apparatus, vending machine, beverage dispenser or apparatus and components therefor.

It is a further object of this invention to provide such dispensers or apparatus, vending machine and beverage dispenser or apparatus, carrying fewer moving parts, making it more reliable and more cost effective and an improved method of dispensing comestibles incorporating water such as beverages, soups and the like.

Further and other objects of the invention will be realized by those skilled in the art from the following summary of the invention and detailed description of an embodiment thereof.

SUMMARY OF THE INVENTION

According to one aspect of the invention, there is provided, a cup dispenser or apparatus, vending machine or beverage dispenser or apparatus, each comprising:

a plurality of stationary cup carrying magazines or stacks spaced from a center, each magazine surmounting a dispenser mechanism for discharging the lowermost cup from the stack or magazine each magazine surmounting a dispenser mechanism for discharging the lowermost cup from the stack or magazine, a cup carrier movable from a discharge station to a position below the dispenser mechanism and stack or magazine from which the lowermost cup is to be discharged, prior to the dispenser mechanism discharging the lowermost cup from the stack or magazine, the cup carrier to receive the cup from the stack or magazine and to be thereafter reciprocated to the discharge station, and means to reciprocate the cup carrier from the discharge station to the position below the dispenser mechanism to be activated to discharge the lowermost cup, and back to the discharge station.

Preferably the plurality of stationary cups carrying magazines or stacks are radially spaced from a center. Also preferably each activator arm is spring loaded. Also preferably, each arm being movable, is vertically pivotable from a position spaced from the activator arm to a position proximate the activator arm, and the means to activate only one activator arm to a position proximate the activator arm, causes the activator arm to pivot to a position proximate the activator arm.

Preferably, means are provided to add water, preferably substantially directly downwardly into the cup at the discharge station after the cup has been carried to the discharge station where the apparatus is employed in a beverage dispenser or apparatus.

According to another aspect of the invention, there is provided a cup dispenser (apparatus, vending machine and a beverage dispsner or apparatus) each dispenser comprising:

a plurality of stationary cup carrying magazines or stacks radially spaced from a center, each magazine surmounting a dispenser mechanism for discharging the lowermost cup from each stack or magazine, means associated with each dispenser mechanism to cause the dispenser mechanism with which it is associated to discharge a cup when operated, means to engage one only of all the means associated with the dispenser mechanisms at any one time, means to activate the means to engage the one only of all the associated means with the dispenser mechanisms at any one time to cause the associated dispenser mechanism to discharge a cup, a cup carrier movable from a discharge station to a position below the dispenser mechanism and stack or magazine from which the lowermost cup is to be discharged prior to the dispenser mechanism discharging the lowermost cup from the stack or magazine, the cup carrier to receive the cup from the stack or magazine and to be thereafter reciprocated to the discharge station and means to reciprocate the cup carrier from the discharge station to the position below the dispenser mechanism to be activated to discharge the lowermost cup and back to the discharge station. Also preferably, means are provided to add water to the cup at the discharge station after the cup has been carried to the discharge station.

Therefore, by the employment of a dispensing machine as herein described, a simple vending and dispensing machine or dispenser may be provided which makes maximum use of available space utilizing fewer components.

In one embodiment, the means to reciprocate the cup carrier may comprise a Geneva gear also carrying the cup carrier, a Geneva drive wheel for precisely indexing the Geneva gear, and thus the cup carrier, from the discharge station to the position below the stack or magazine from which the cup is to be discharged and back to the discharge station, and, a motor for driving the Geneva gear.

Additionally, the dispenser mechanism may be of a construction shown in co-pending U.S. Application Ser. No. 291,465 now abandoned.

The means associated with each dispenser mechanism to cause the dispenser mechanism to discharge a cup when operated comprises a spring loaded activator arm extending from an opening in the body of each dispenser mechanism and which activator arm is movable across a portion of the body of the dispenser mechanism compressing the spring activating the dispenser mechanism to discharge the lowermost cup from the stack or magazine and thereafter, be returned to its original position under the action of the spring.

Furthermore, the means to engage one only of all the means associated with the dispenser mechanisms comprises a plurality of actuator arms, one for each activator arm of each dispenser mechanism, each actuator arm being vertically pivotable from a position spaced from the activator arm to a position proximate the activator arm, only one activator arm being pivotable to a position proximate the activator arm at any one time.

Each actuator arm may be pivoted to its position proximate the activator arm by the action of a circular cam carried by and indexed above, the Geneva gear as the Geneva gear is indexed, (preferably being carried by and indexed by the Geneva gear) the cam comprising a low or flat on its circumference above the position of the Geneva gear whereat the cup carrier is positioned; and a plurality of cam followers (one for each actuator arm) (in one embodiment pins or rods) for following the circumference of the circular cam indexed above the Geneva gear each cam follower causing its associated actuate arom to pivot from an elevated position raised from the activator arm to a position proximate the actuator arm when the associated cam follower engages the low or flat of the circular arm.

The actuator arms may be carried by a plate (cup drop cam) to be pivoted one at a time from their raised positions, to a position between their raised positions and the surface of the cup drop cam when each engages the low or flat of the circular cam to position the pivoted actuator arm in a plane to engage its associated activator arm. When the pivoted actuator arm is for example rotated, it engages its associated activator arm pushing the activator arm across the body of the dispenser mechanism against the action of the spring to activate the dispensing mechanism to drop the lowermost cup. After the cup drop cam has been rotated through a predetermined arc of a circle to rotate the pivoted actuator arm to push the activator arm across the body of the dispenser mechanism compressing the spring to activate the dispenser mechanism. It is returned in the same arc in the opposite director releasing the spring tension permitting the activator arm to return to its initial position.

Preferably, the cup drop cam is caused to rotate through an arc of a circle by the rotation of a stud about a center spaced from the stud and spaced from the periphery and center of the cup drop cam, the stud being carried in a radially extending slot in a radially extending arm or armature secured to the cup drop cam which arm or armature extends beyond the periphery of the cup drop cam to cause the cup drop cam to rotate through an arc of a circle and be returned to its initial position after one revolution of the stud to its original position thereby reciprocating the cup drop cam through an arc in one direction sufficiently to cause the pivoted actuator arm to push the activator arm across the body of the dispenser mechanism to discharge a cup and arcuately return the cup drop cam and the pivotable actuator arm along the same path to its original position.

After the cup has been dropped into the cup carrier, the cup is indexed to the discharge station where water may be discharged directly into the cup for mixing the beverages.

Therefore, as is evident, the beverage dispensing machine requires the use of only two small motors (each about 17 lb.-inches torque), one motor for the operation of the Geneva drive and the other for rotation of the stud in the slot of the armature for the reciprocal arcuate motion of the cup drop cam causing the pivoted actuator arm to push the activator arm for dispensing the lowermost cup.

BRIEF DESCRIPTION OF THE DRAWINGS

The invention will now be illustrated with reference to the following drawings of an embodiment of the invention in which.

DETAILED DESCRIPTION OF THE DRAWINGS

Figure 1:
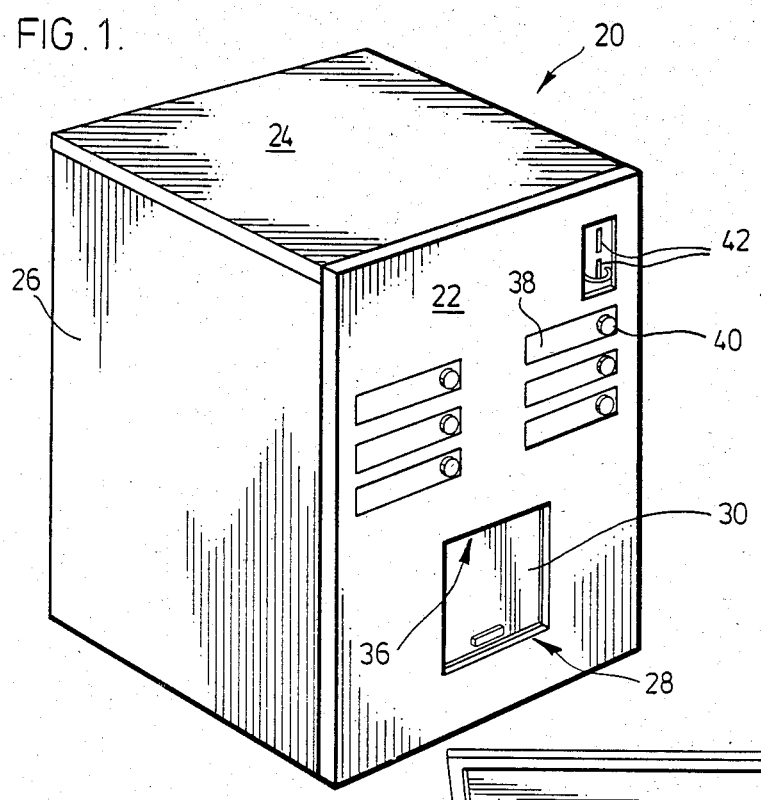
FIG. 1 is a perspective view of a beverage dispenser according to an embodiment of the invention.
Figure 2:
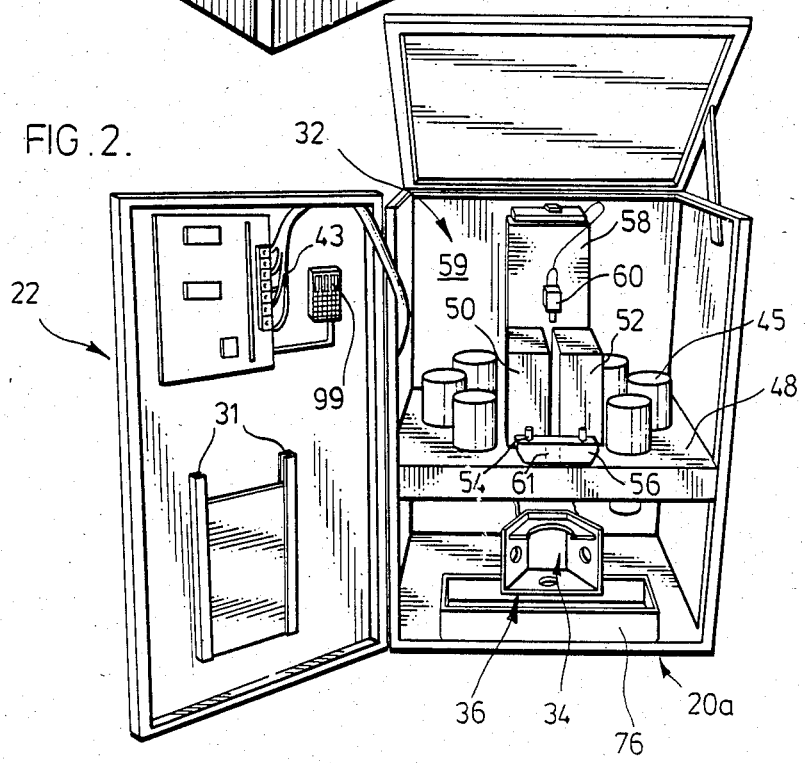
FIG. 2 is a perspective view of components within the compartment of the structure shown in FIG. 1.

With reference to FIG. 1, there is disclosed beverage dispensing machine 20 comprising front door 22 and top, side, bottom and back walls, two of which are shown as 24 (top wall) and 26 (side wall). Door 22 has opening 28 therethrough covered by vertically slidable transparent door 30 for sliding vertically in channels 31 (see FIG. 2) to present access into compartment 32 (See FIG. 2) to cup carrier 34 (see FIG. 2), normally situate at discharge station 36 behind transparent door 30.

Front door 22 carries face plates 38, dispensing buttons 40 and coin slot 42, each plate 38 identifying the type of beverage to be dispensed by the machine by the depression of the adjacent bottom 40 after the deposition of the appropriate amount of money into coin slot 42.

The back of door 22 carries the appropriate electronics 43 for reacting to the depression of any button 40 and deposition of the requisite coins into slot 42, to activate the operation of the component parts of beverage dispenser machine 20 to provide a beverage in a cup in cup carrier 34 at discharge station 36.

Figure 3:
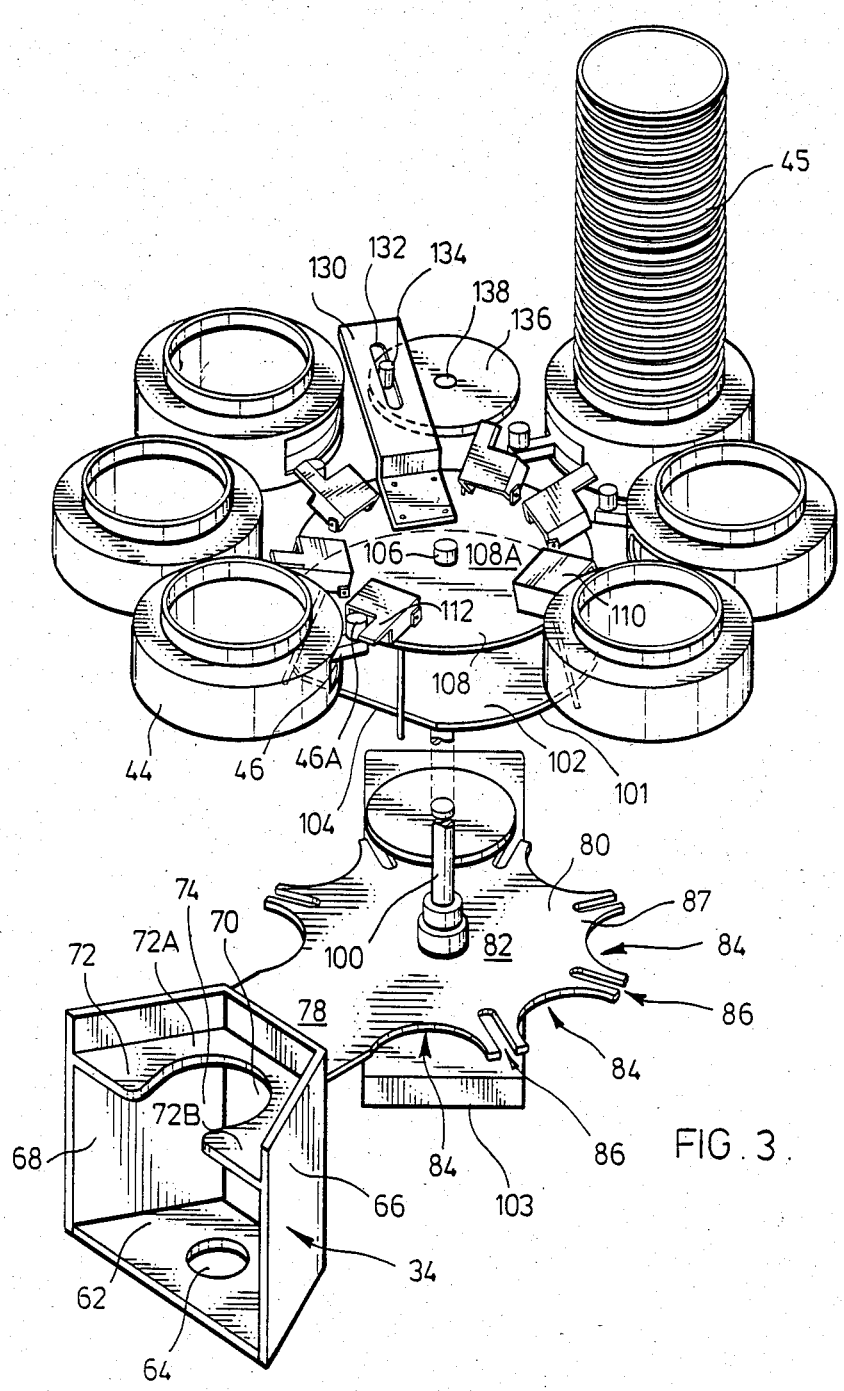
FIG. 3 is a perspective view of part of the structure of the beverage dispensing apparatus of FIGS. 1 and 2.
Figure 6:
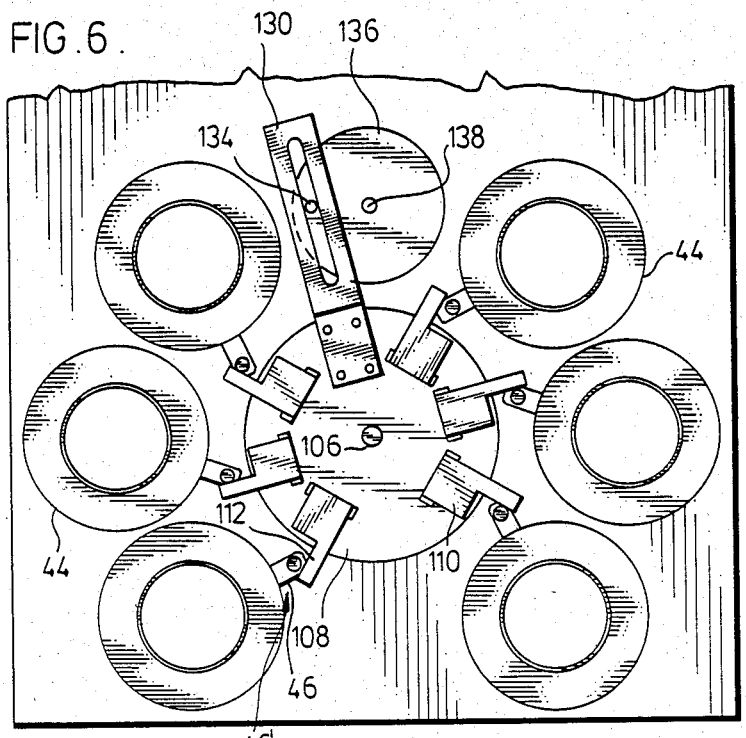
FIGS. 6 and 7 are top views of components in FIG. 3 illustrating the operation thereof.
Figure 7:
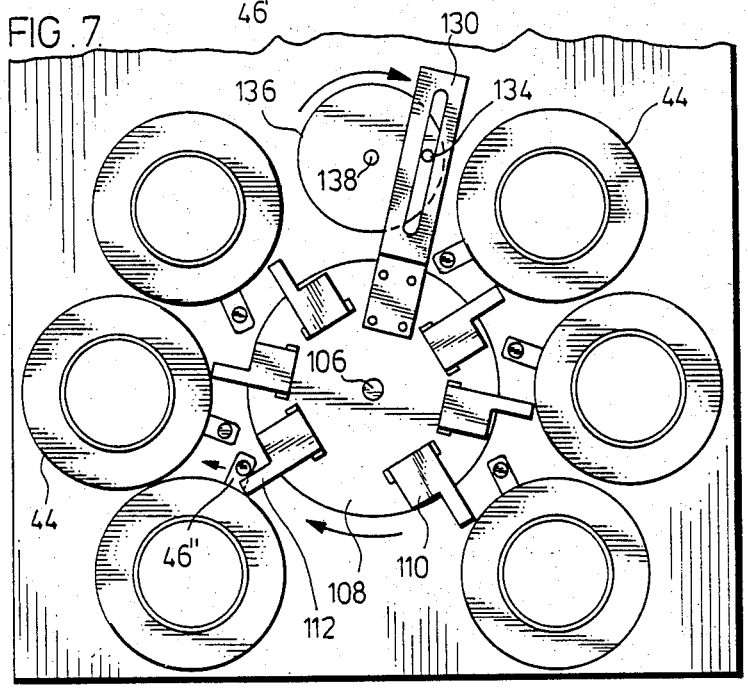

Compartment 32 carries a plurality of cup dispenser mechanisms 44 (see FIG. 3) constructed in accordance with the teachings of U.S. patent application Ser. No. 291,465 radially spaced from a centre 106 (See FIG. 3) each carrying a stack of foam cups 45 with each cup carrying dry beverage ingredients for mixing with water. Each dispenser mechanism 44 carries activator arm 46 (carrying vertically extending stud 46A) rotatable from an initial position shown in FIG. 6 as 46' across the body of dispenser mechanism 44 to the position shown in FIG. 7 as 46" to discharge the lowermost cup. Each activator arm 46 is spring loaded so that after being forced arcuately across a portion of the body of mechanism 44 and upon being released, it returns to its initial position shown in FIG. 6 at 46'.

Figure 10:
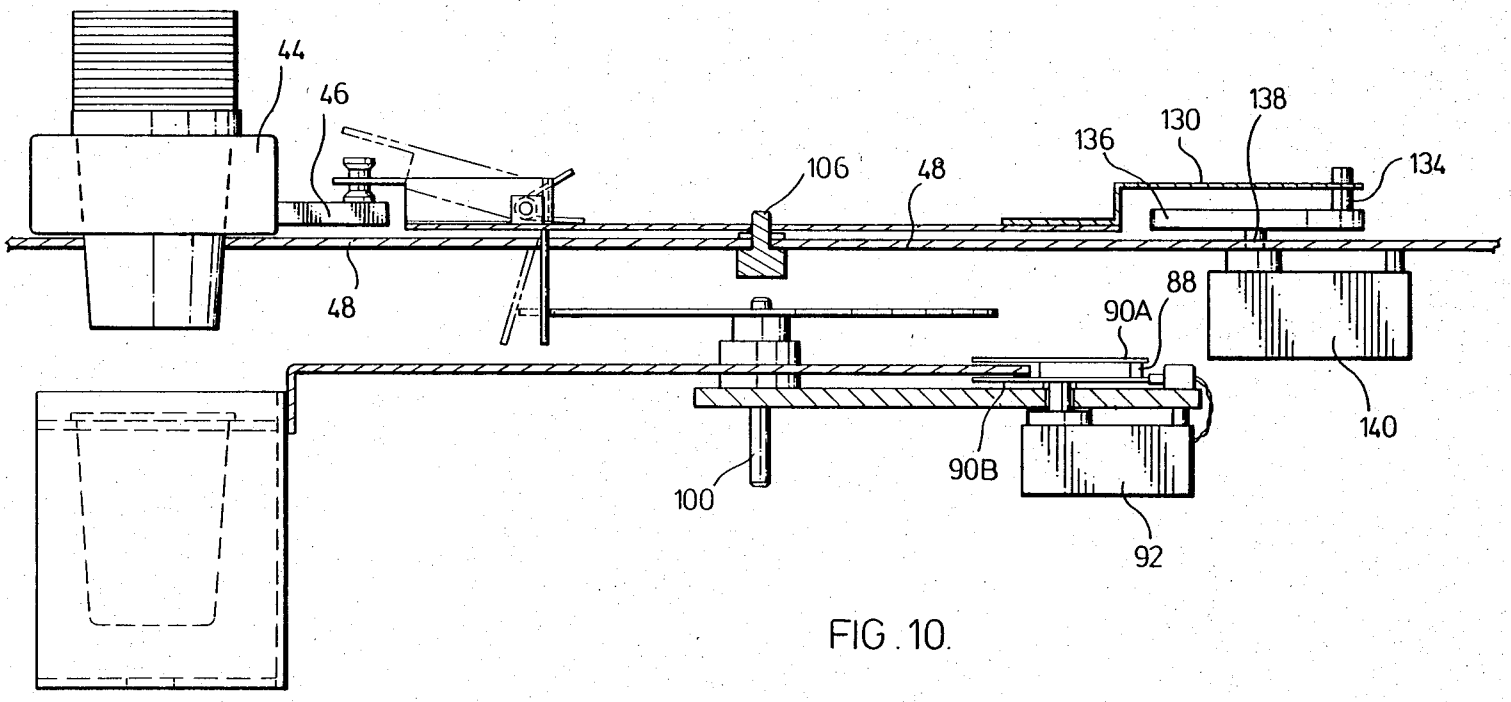
FIG. 10, is a side view of the structure shown in FIG. 3.

Dispenser mechanisms 44 are mounted to shelf 48 (see FIG. 10) to extend therethrough. Shelf 48 also supports creamer and sugar cannisters 50 and 52, two augers (not shown) for discharging the ingredients from cannisters 50 and 52, one for each cannister with each auger driven by a separate motor (54 and 56) to discharge the ingredients carried by cannisters 50 and 52 into cups positioned at discharge station 36 in carrier 34.

Water heater 58 mounted on the back panel 59 of machine 20 and controlled by solenoid 60 is provided from which heater water is discharged directly downwardly by discharge outlet 61 (shown in FIG. 2), into the cup positioned by cup carrier 34 at discharge station 36.

Cup carrier 34 (see FIG. 3) comprises base 62 having hole 64 therethrough, side walls 66 and 68, back wall 70 and recessed U-shaped top 72 comprising two arms 72A and 72B surrounding opening 74 through which a discharged cup falls when discharged from dispenser 44 into carrier 34. Hole 64 has been provided to drain fluid accidentally spilled from the cup when filled or when the filled cup is removed by the purchaser. Spill tray 76 (see FIG. 2) is provided below discharge station 36 to holding the spilled fluid.

Figure 4:
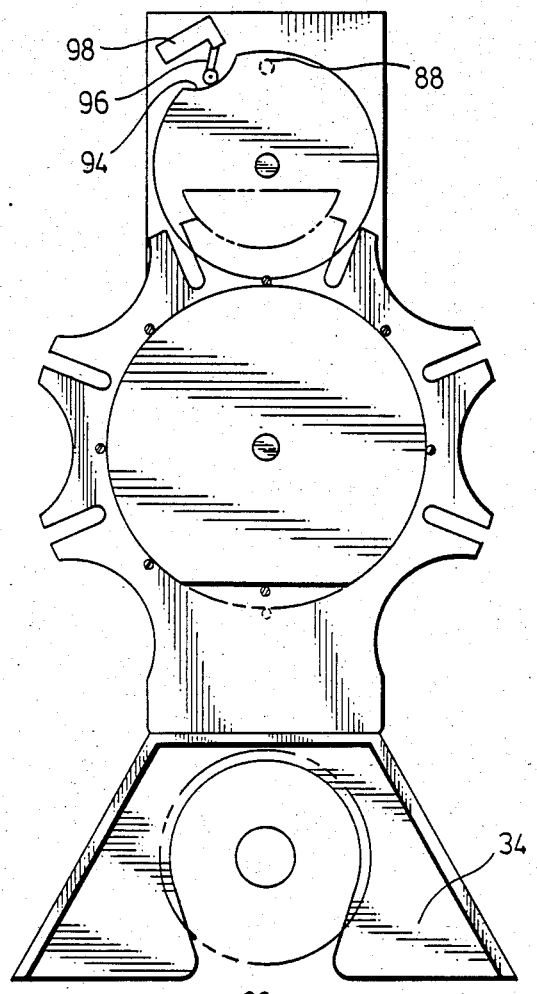
FIGS. 4 and 5 are top views of components in FIG. 3 illustrating the operation thereof.
Figure 5:
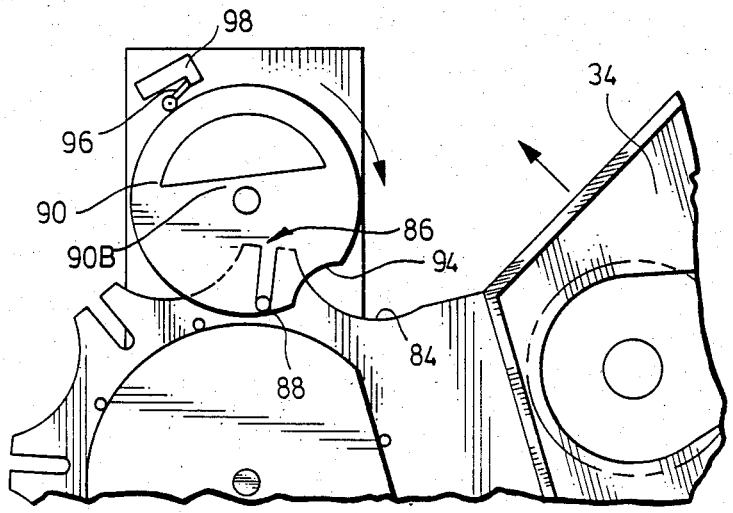

Cup carrier 34 is secured to arm 78 of Geneva gear 80 (See FIG. 3) comprising flat plate 82 carrying curved recessed peripheral portions 84 and radially extending arms 87 carring radially extending slots 86 into one of which slots, stud 88 is inserted by Geneva drive wheel 90 (see FIG. 5) driven by motor 92 (see FIG. 10) for indexing of the Geneva gear from a position below each dispenser to the one adjacent to it (See FIGS. 4 and 5). Geneva drive wheel 90 comprises spaced circular plates 90A and 90B spaced from one another by studs 88 (See FIG. 10). Shallow or depression 94 in the edge of disc 90A has been provided for engaging arm 96 of switch 98 for turning the motor 92 off when arm 96 enters depression or shallow 94. At all other times arm 96 follows the outer periphery of upper plate 90A of Geneva drive wheel 90 without permitting disengagement of motor 92.

Adjacent slots 86 are spaced so that by the rotation of a stud 88 through an arc of a circle either clockwise or counterclockwise, the stud rotates the cup carrier 34 from a position at discharge station 36 to a position below the adjacent cup dispenser 44 whereat it disengages the Geneva gear. By continuing rotation of the drive wheel 90, a stud 88 enters the next adjacent slot 86 to index the Geneva gear 82 from its position below a cup dispenser mechanism 44 to the one next to it and so on. Therefore, the movement of cup carrier 34 will depend on which button 40 is depressed and the "directions" given by electronics 43 including microprocessor 99 secured to the back of door 22 associated with that button 40. Particularly, the depression of each button 40 will cause motor 92 to be re-activated a given number of times after being switched off by switch 98 when arm 96 enters shallow or depression 94, to rotate drive wheel 90 a given number of times thereby rotating cup carrier to a position below the desired dispenser mechanism 44 and stack 45 and from which stack one foam cup carrying the desired ingredients is to be discharged.

Geneva gear 80 is rotated about vertically extending rod 100, secured at one end to circular cam 102 providing low or flat 104 aligned with arm 78 of Geneva gear 80 and at the other end, to support 103 secured to the bottom 20A (See FIG. 2) of machine 20.

Dispensers 44 are radially spaced from center 106 coinciding with the vertical extension of rod 100 (See FIG. 10) and overlie the positions to which cup carrier 34 is indexed after rotation of Geneva gear 80 by stud 88.

Figure 8:
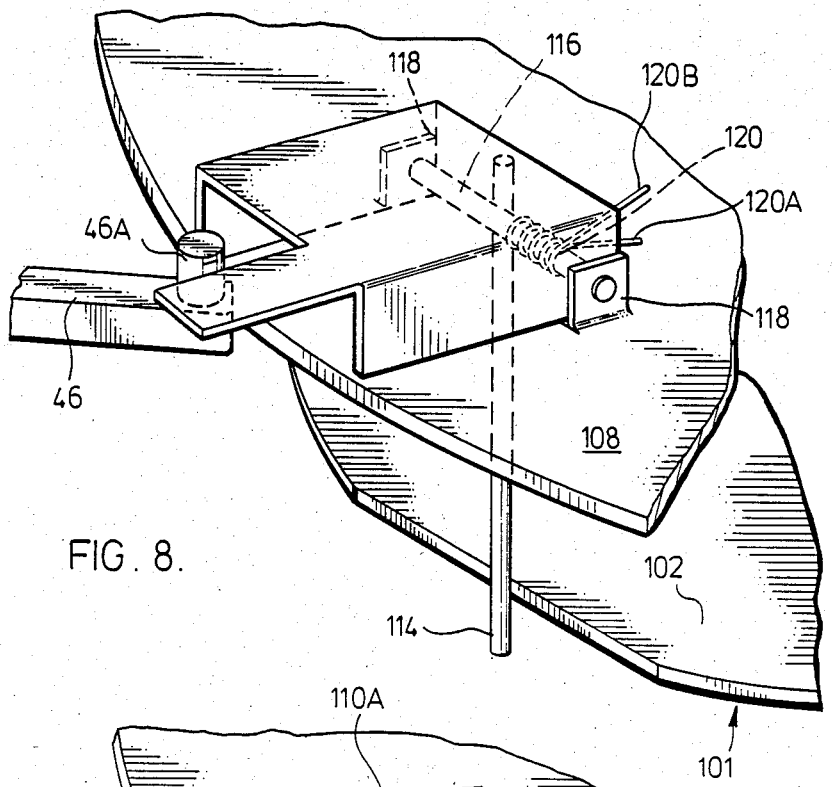
FIGS. 8 and 9 are perspective close-up views of components in FIGS. 3, 6 and 7 illustrating their operation.
Figure 9:
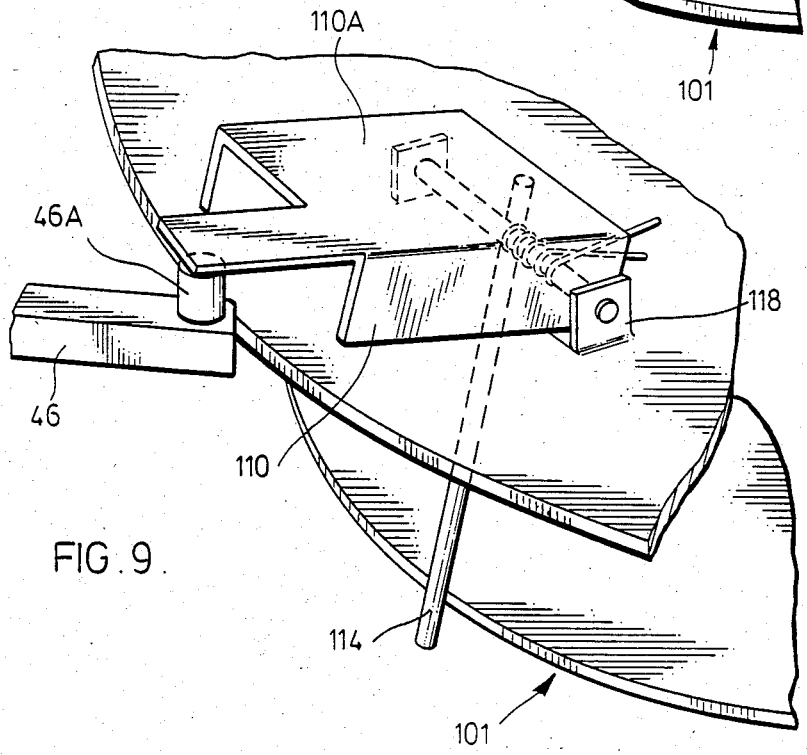

Center 106 is also the center of cup drop cam 108 carrying a plurality of actuator arms 110, one for each dispenser mechanism 44, each actuator arm 110 carrying radially extending extension 112. Each arm 110 is pivotal from an elevated position spaced from surface 108A of cup drop cam 108 (See FIG. 9) to a position substantially parallel to the plane of surface 108A intermediate its elevated position and surface 108A as shown in FIG. 8.

For pivoting arm 110, each arm 110 carries pin 114 (cam follower) extending from arm 110 substantially normal to the plane of the top 110A of arm 110. Each pin 114 is secured to shaft 116 (axis of rotation) extending parallel to top 110A and supported for pivotal rotation in supports 118 extending upwardly from cup drop cam 108 (see FIGS. 8 and 9) on either side of arm 110. Compression spring 120 is wound on each shaft 116 with one end 120A abutting cup drop cam 108 and the other end 120B touching top 110A of actuator arm 110. Each pin 114 extends through an aperture (not shown) in cup drop cam 108 and is positioned to sit against the outer periphery 101 of cam 102 at all times, maintained by the action of compression spring 120 between cup drop cam 108 and top 110A. As is apparent from FIGS. 3, 8 and 9, whenever pin 114 engages the curved portion of periphery 101 of circular cam 102, the plane of top 110A is angled to the plane of cup drop cam 108. However, whenever pin 114 engages low or flat 104, the plane of top 110A is pivoted to be parallel to the plane of cup drop cam 108. In this position, arm 110 is in a plane to engage vertically extending stud 46A of activator arm 46 of dispenser mechanism 44. It is also apparent that from the length of flat 104, that only one pin 114 may engage the flat at any one time. Therefore, only one arm 110 can be positioned in a plane to engage only one vertically extending stud 46A at a time.

For activating one such arm 110 so positioned, to cause the associated dispenser 44 to discharge a cup, cup drop cam 108 is reciprocated through an arc of its circumference and returned to its initial position forcing vertically extending stud 46A on the associated actuator arm 46 to rotate against the action of the compression spring (not shown) to discharge a cup and be returned to its initial position when arm 110 returns to its initial position.

To reciprocate cup drop cam 108 through an arc of its circumference, cup drop cam 108 carries radially extending arm 130 (See FIG. 3) carrying radially extending slot 132 therein and which arm 130 extends beyond the peripheral edge of cup drop cam 108. Projection or stud 134 is carried on disc 136 spaced from cup drop cam 108, rotatable about axis 138 by motor 140 (see FIG. 10) and is carried in slot 132 of arm 130.

Therefore, as disc 136 rotates about center 138, stud 134 is rotated once causing arm 130 to translate the single rotation of stud 134 to reciprocate cup drop cam 108 and each arm 110 arcuately in a clockwise direction causing pivoted arm 110 to push the associated stud 46A and arm 46 to position 46'' (See FIG. 7) remote its initial position 46' (see FIG. 6) to discharge a cup into cup carrier 34 and thereafter, return each arm 110 counterclockwise to its initial position, thus permitting the engaged stud 46A and arm 46 to return to its initial position 46' by the action of the spring (not shown).

As is apparent, all arms 110 act in a similar manner (that is move clockwise through an arc to remote positions and then move counterclockwise to their initial position). Because the pins 114 (cam followers) of the other arms 110 engage circular portions of the periphery 101 of circular arm 102 (and not the flat or low 104) the extensions 112 of the other arms 110 are elevated relative to stud 46A of arms 46 and do not activate other dispensers 44 (See FIGS. 6 and 7). Therefore, after cup carrier 34 has been indexed to a position below the selected dispenser 44, cup drop cam 108 is activated in the manner described by the single rotation of stud 134 (controlled by the electronics 43) to cause the lowermost cup to be discharged from the dispenser 44 above cup carrier 34.

Once the selected cup has been discharged into cup carrier 34, the electronics 43 automatically causes cup carrier 34 to be indexed to discharge station 36 in the opposed direction by reversing the rotation of drive wheel 90. The cup is then automatically filled by the discharge of water directed downwardly from outlet 61 into the cup mixing and dissolving the ingredients for retrieval of the beverage by the purchaser.

As many changes can be made to the structure of the embodiment of the invention without departing from the scope of the invention, it is intended that all matter contained herein shall be interpreted as illustrative of the invention and not in a limiting sense.

The embodiments of the invention in which an exclusive property or privilege is claimed are as follows:

1. A cup dispenser, comprising:

a plurality of stationary cup carrying magazines or stacks, each magazine surmounting a dispenser mechanism for discharging the lowermost cup from the stack or magazine, an activator arm secured to each dispenser which arm is movable across relative to the dispenser to discharge the lowermost cup from the stack or magazine and thereafter be returned to its original position, a plurality of actuator arms, one for each activator arm of each dispenser mechanism, each actuator arm being movable from a position spaced from the activator arm to a position proximate the activator arm, only one actuator arm being pivotable to a position proximate the activator arm at any one time, means to activate only one actuator arm to move to a position proximate the activator arm, and means to activate the actuator arm to engage the activator arm to cause the activator arm to move relative to the dispenser to discharge the lowermost cup from the magazine or stack, a cup carrier movable from a discharge station to a position below the dispenser mechanism and stack or magazine from which the lowermost cup is to be discharged, prior to the dispenser mechanism discharging the lowermost cup from the stack or magazine, the cup carrier to receive the cup from the stack or magazine and to be reciprocated to the discharge station and means to reciprocate the cup carrier from the discharge station to the position below the dispenser mechanism to be activated to discharge the lowermost cup, and back to the discharge station.

2. The dispenser of claim 1, wherein the means to reciprocate the cup carrier comprises a Geneva Gear carrying the cup carrier and a Geneva Drive Wheel, for precisely indexing the Geneva Gear and the cup carrier from the discharge station to the position below the stack or magazine from which the cup is to be discharged and back to the discharge station, and a motor for driving the Geneva Gear.

3. The cup dispenser of claim 1 wherein the plurality of stationary cup carrying magazines or stacks are radially spaced from a center.

4. The cup dispenser of claim 2, wherein each activator arm is spring loaded.

5. The cup dispenser of claim 1, wherein each actuator arm being movable is vertically pivotable from a position spaced from the activator arm to a position proximate the activator arm, and the means to activate only one actuator arm to move to a position proximate the activator arm, causes the actuator arm to pivot to a position proximate the activator arm.

6. The cup dispenser of claim 2, wherein each actuator arm being movable is vertically pivotable from a position spaced from the activator arm to a position proximate the activator arm, and the means to activate only one actuator arm to move to a position proximate the activator arm, causes the actuator arm to pivot to a position proximate the activator arm.

7. The dispenser of claim 3, wherein means are also provided to add water substantially directly downwardly into the cup at the discharge station after the cup has been carried to the discharge station.

8. The dispenser of claim 3, wherein the means to reciprocate the cup carrier comprises a Geneva Gear carrying the cup carrier and a Geneva Drive Wheel, for precisely indexing the Geneva Gear and the cup carrier from the discharge station to the position below the stack or magazine from which the cup is to be discharged and back to the discharge station, and a motor for driving the Geneva Gear.

9. A cup dispenser comprising:

a plurality of stationary cup carrying magazines or stacks radially spaced from a center, each magazine surmounting a dispenser mechanism for discharging the lowermost cup from each stack or magazine, means associated with each dispenser mechanism to cause the dispenser mechanism with which it is associated to discharge a cup when operated, means to engage one only of all the means associated with the dispenser mechanisms at any one time, means to activate the means to engage the one only of all the means associated with the dispenser mechanisms at any one time to cause the associated dispenser mechanism to discharge a cup, a cup carrier movable from a discharge station to a position below the dispenser mechanism and stack or magazine from which the lowermost cup is to be discharged prior to the dispenser mechanism discharging the lowermost cup from a stack or magazine, the cup carrier to receive the cup from a stack or magazine and to be thereafter reciprocated to the discharge station and means to reciprocate the cup carrier from the discharge station to the position below the dispenser mechanism to be activated to discharge the lowermost cup and back to the discharge station, wherein the means associated with each dispenser mechanism to cause the dispenser mechanism with which it is associated to discharge a cup when operated, comprises a spring loaded activator arm extending from an opening in the body of each dispenser mechanism and which activator arm is pivotable across a portion of the body of the dispenser mechanism comprising the spring activating the dispenser mechanism to discharge the lowermost cup from the stack or magazine, and thereafter be returned to its original position under the action of the spring, and wherein the means to engage one only of all the means associated with the dispenser mechanism at one time comprises a plurality of actuator arms, one for each activator arm of each dispenser mechanism, each actuator arm being vertically pivotable from a position spaced from the activator arm to a position proximate the activator arm, only one activator arm being pivotable to a position proximate the activator arm at any one time.

10. The dispenser of claim 9, wherein means are provided to add water to a cup at the discharge station after the cup has been carried to the discharge station.

11. The dispenser of claim 9, wherein the means to reciprocate the cup carrier comprises a Geneva Gear carrying the cup carrier and a Geneva Drive Wheel, for precisely indexing the Geneva Gear and the cup carrier from the discharge station to the position below the stack or magazine from which the cup is to be discharged and back to the discharge station, and a motor for driving the Geneva Gear.

12. The dispenser of claim 10, wherein the means to reciprocate the cup carrier comprises a Geneva Gear carrying the cup carrier and a Geneva Drive Wheel, for precisely indexing the Geneva Gear and the cup carrier from the discharge station to the position below the stack or magazine from which the cup is to be discharged and back to the discharge station, and a motor for driving the Geneva Gear.

13. The dispenser of claim 9, wherein each actuator arm is pivoted to its position proximate the activator arm by the action of:

a circular cam carried by and indexed above, the Geneva Gear as the Geneva Gear is indexed, the cam comprising a low or flat on its circumference above the position of the Geneva Gear whereat the cup carrier is positioned; and a plurality of cam followers (one for each actuator arm) for following the circumference of the cicular arm indexed above the Geneva Gear, each cam follower causing its associated actuator arm from an elevated position raised from the activator arm to a position proximate the actuator arm when the associated cam follower engages the low or flat of the circular cam.

14. The dispenser of claim 10, wherein each actuator arm is pivoted to its position proximate the activator arm by the action of:

a circular cam carried by and indexed above, the Geneva Gear as the Geneva Gear is indexed, the cam comprising a low or flat on its circumference above the position of the Geneva Gear whereat the cup carrier is positioned; and a plurality of cam followers (one for each actuator arm) for following the circumference of the circular arm indexed above the Geneva Gear, each cam follower causing its associated actuator arm from an elevated position raised from the activator arm to a position proximate the actuator arm when the associated cam follower engages the low or flat of the circular cam.

15. The dispenser of claim 11, wherein each actuator arm is pivoted to its position proximate the activator arm by the action of:

a circular cam carried by and indexed above, the Geneva Gear as the Geneva Gear is indexed, the cam comprising a low or flat on its circumference above the position of the Geneva Gear whereat the cup carrier is positioned; and a plurality of cam followers (one for each actuator arm) for following the circumference of the circular arm indexed above the Geneva Gear, each cam follower causing its associated actuator arm from an elevated position raised from the activator arm to a position proximate the actuator arm when the associated cam follower engages the low or flat of the circular cam.

16. The dispenser of claim 12, wherein each actuator arm is pivoted to its position proximate the activator arm by the action of:

a circular cam carried by and indexed above, the Geneva Gear as the Geneva Gear is indexed, the cam comprising a low or flat on its circumference above the position of the Geneva Gear whereat the cup carrier is positioned; and a plurality of cam followers (one for each actuator arm) for following the circumference of the circular arm indexed above the Geneva Gear, each cam follower causing its associated actuator arm from an elevated position raised from the activator arm to a position proximate the actuator arm when the associated cam follower engages the low or flat of the circular cam.

17. The dispenser of claim 13, wherein the circular cam is also indexed by the Geneva Gear.

18. The dispenser of claim 14, wherein the circular cam is also indexed by the Geneva Gear.

19. The dispenser of claim 15, wherein the circular cam is also indexed by the Geneva Gear.

20. The dispenser of claim 16, wherein the circular cam is also indexed by the Geneva Gear.

21. The dispenser of claim 13, wherein the actuator arms are carried by a plate comprising a cup drop cam, the actuator arms to be pivoted one at a time from their raised positions, to a position between their raised positions and the surface of the cup drop cam when each engages the low or flat of the circular cam to position the pivoted actuator arm in a plane to engage its associated activator arm when the drop cam is rotated through an arc of a circle to push its associated activator arm across the body of the dispenser mechanism against the action of the spring to dispense a cup and to permit the engaged activator arm to be released and to be returned to its initial position by the decompression of the spring when the cup drop cam is reciprocated in the opposite direction.

22. The dispenser of claim 14, wherein the actuator arms are carried by a plate comprising a cup drop cam, the actuator arms to be pivoted one at a time from their raised positions, to a position between their raised positions and the surface of the cup drop cam when each engages the low or flat of the circular cam to position the pivoted actuator arm in a plane to engage its associated activator arm when the drop cam is rotated through an arc of a circle to push its associated activator arm across the body of the dispenser mechanism against the action of the spring to dispense a cup and to permit the engaged activator arm to be released and to be returned to its initial position by the decompression of the spring when the cup drop cam is reciprocated in the opposite direction.

23. The dispenser of claim 15, wherein the actuator arms are carried by a plate comprising a cup drop cam, the actuator arms to be pivoted one at a time from their raised positions, to a position between their raised positions and the surface of the cup drop cam when each engages the low or flat of the circular cam to position the pivoted actuator arm in a plane to engage its associated activator arm when the drop cam is rotated through an arc of a circle to push its associated activator arm across the body of the dispenser mechanism against the action of the spring to dispense a cup and to permit the engaged activator arm to be released and to be returned to its intial position by the decompression of the spring when the cup drop cam is reciprocated in the opposite direction.

24. The dispenser of claim 16, wherein the actuator arms are carried by a plate comprising a cup drop cam, the actuator arms to be pivoted one at a time from their raised positions, to a position between their raised positions and the surface of the cup drop cam when each engages the low or flat of the circular cam to position the pivoted actuator arm in a plane to engage its associated activator arm when the drop cam is rotated through an arc of a circle to push its associated activator arm across the body of the dispenser mechanism against the action of the spring to dispense a cup and to permit the engaged activator arm to be released and to be returned to its initial position by the decompression of the spring when the cup drop cam is reciprocated in the opposite direction.

25. The dispenser of claim 21, wherein the rotation of the cup drop cam is accomplished by the rotation of a stud about a center spaced from the stud and spaced from the periphery and center of the cup drop cam, the stud being carried in a radially extending slot in a radially extending arm or armature secured to the cup drop cam which arm or armature extends beyond the periphery of the cup drop cam to cause the cup drop cam to rotate through an arc of a circle and be returned to its initial position after one revolution of the stud to its original position thereby reciprocating the cup drop cam through an arc in one direction sufficiently to cause the pivoted actuator arm to push the activator arm across the body of the dispenser mechanism to discharge a cup and arcuately return the cup drop cam and the pivotable actuator arm along the same path to its original position.

26. The dispenser of claim 22, wherein the rotation of the cup drop cam is accomplished by the rotation of a stud about a center spaced from the stud and spaced from the periphery and center of the cup drop cam, the stud being carried in a radially extending slot in a radially extending arm or armature secured to the cup drop cam which arm or armature extends beyond the periphery of the cup drop cam to cause the cup drop cam to rotate through an arc of a circle and be returned to its initial position after one revolution of the stud to its original position thereby reciprocating the cup drop cam through an arc in one direction sufficiently to cause the pivoted actuator arm to push the activator arm across the body of the dispenser mechanism to discharge a cup and arcuately return the cup drop cam and the pivotable actuator arm along the same path to its original position.

27. The dispenser of claim 23, wherein the rotation of the cup drop cam is accomplished by the rotation of a stud about a center spaced from the stud and spaced from the periphery and center of the cup drop cam, the stud being carried in a radially extending slot in a radially extending arm or armature secured to the cup drop cam which arm or armature extends beyond the periphery of the cup drop cam to cause the cup drop cam to rotate through an arc of a circle and be returned to its initial position after one revolution of the stud to its original position thereby reciprocating the cup drop cam through an arc in one direction sufficiently to cause the pivoted actuator arm to push the activator arm across the body of the dispenser mechanism to discharge a cup and arcuately return the cup drop cam and the pivotable actuator arm along the same path to its original position.

28. The dispenser of claim 24, wherein the rotation of the cup drop cam is accomplished by the rotation of a stud about a center spaced from the stud and spaced from the periphery and center of the cup drop cam, the stud being carried in a radially extending slot in a radially extending arm or armature secured to the cup drop cam which arm or armature extends beyond the periphery of the cup drop cam to cause the cup drop cam to rotate through an arc of a circle and be returned to its initial position after one revolution of the stud to its original position thereby reciprocating the cup drop cam through an arc in one direction sufficiently to cause the pivoted actuator arm to push the activator arm across the body of the dispenser mechanism to discharge a cup and arcuately return the cup drop cam and the pivotable actuator arm along the same path to its original position.

29. The dispenser of claim 25, wherein the stud is carried by a circular plate.

30. The dispenser of claim 26, wherein the stud is carried by a circular path.

31. The dispenser of claim 27, wherein the stud is carried by a circular plate.

32. The dispenser of claim 28, wherein the stud is carried by a circular plate.

* * * * *

UNITED STATES PATENT AND TRADEMARK OFFICE

CERTIFICATE OF CORRECTION

PATENT NO. : 4,632,274

DATED : December 30, 1986

INVENTOR(S) : Manfred Garbe

It is certified that error appears in the above-identified patent and that said Letters Patent is hereby corrected as shown below:

In column 2 at line 44, after 'beverage' and before 'or', the word dispsner" has been deleted and the word ---dispenser--- substituted therefor;

In column 3 at line 49, after 'actuate' and before 'to', the word "arom" has been deleted and the word ---arm--- substituted therefor;

In column 4 at line 1, after 'opposite' and before 'releasing', the word "director" has been deleted and the word ---direction--- substituted therefor;

In column 8 at line 30, after 'claim' and before ',', the number "2" has been replaced with the number ---3---;

In column 8 at line 39, after 'claim' and before ',', the number "2" has been replaced with the number ---3---;

UNITED STATES PATENT AND TRADEMARK OFFICE

CERTIFICATE OF CORRECTION

PATENT NO. : 4,632,274

DATED : December 30, 1986

INVENTOR(S) : Manfred Garbe

It is certified that error appears in the above-identified patent and that said Letters Patent is hereby corrected as shown below:

In column 8 at line 50, after 'claim' and before ',', the number "3" has been replaced with the number ---7---.

Signed and Sealed this

Third Day of November, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,632,274

DATED : December 30, 1986

INVENTOR(S) : Manfred Garbe

It is certified that error appears in the above-identified patent and that said Letters Patent is hereby corrected as shown below:

ON THE TITLE PAGE,
Please insert item 73:

-- Assignee: Roboserve Limited --.

Signed and Sealed this

Fifth Day of January, 1988

*Attest:*

DONALD J. QUIGG

*Attesting Officer*

*Commissioner of Patents and Trademarks*